US006022260A

United States Patent [19]

Fritzel

[11] Patent Number: 6,022,260

[45] Date of Patent: Feb. 8, 2000

[54] KIT FOR CONSTRUCTING A MODEL ROCKET

[76] Inventor: John Fritzel, 718 Sutton Cir., Wheeling, Ill. 60090

[21] Appl. No.: 09/016,651

[22] Filed: Jan. 30, 1998

[51] Int. Cl.[7] ..... A63H 17/00; A63H 33/14; A63H 27/26; A63H 33/00

[52] U.S. Cl. ..... 446/93; 446/87; 446/56; 446/488; D21/16.1

[58] Field of Search ..... 446/87, 88, 93, 446/94, 85, 56, 34, 488, 487; 244/3.24, 16; D21/452; D12/16.1, 319

[56] References Cited

U.S. PATENT DOCUMENTS

| | | | |
|---|---|---|---|
| D. 405,848 | 2/1999 | Mooradian | D21/452 |
| 2,676,431 | 4/1954 | Goldberg | 446/88 |
| 2,851,950 | 9/1958 | Van Aken et al. . | |
| 3,787,013 | 1/1974 | McKenzie, Sr. | 244/155 R |
| 3,805,355 | 4/1974 | Gornik . | |
| 3,888,178 | 6/1975 | Senoski . | |
| 3,942,441 | 3/1976 | Senoski . | |
| 3,943,656 | 3/1976 | Green . | |
| 4,142,321 | 3/1979 | Coppa | 446/488 |
| 4,202,132 | 5/1980 | Fischer . | |
| 4,257,152 | 3/1981 | Paton . | |
| 4,295,290 | 10/1981 | Boswell . | |
| 4,355,577 | 10/1982 | Ady et al. . | |
| 4,374,493 | 2/1983 | Hoffing . | |
| 4,940,195 | 7/1990 | Jackson | 446/487 X |
| 5,004,186 | 4/1991 | Hans et al. . | |
| 5,234,727 | 8/1993 | Hoberman | 446/488 X |
| 5,267,885 | 12/1993 | Niskern et al. . | |
| 5,458,521 | 10/1995 | Todd | 446/488 X |
| 5,715,446 | 2/1998 | Spence | 446/56 X |

FOREIGN PATENT DOCUMENTS

| | | | |
|---|---|---|---|
| 923890 | 7/1947 | France | 446/88 |
| 1012645 | 12/1965 | United Kingdom | 446/93 |
| WO 86/03985 | 7/1986 | WIPO | 446/94 |

*Primary Examiner*—D Neal Muir
*Attorney, Agent, or Firm*—Leydig, Voit & Mayer, Ltd.

[57] ABSTRACT

A model rocket kit which has a substantially lower material and manufacturing cost is provided. The model rocket kit includes at least one flat sheet of cardboard material which includes the outlines of the various components of a model rocket such as the rocket frame, nose cone, and recovery device. In order to assemble the model rocket, the various components are either punched by means of perforations or cut out of the flat sheet of cardboard material. The various components of the model rocket are then folded into the appropriate form and secured using conventional adhesive tape or the like. The resulting model rocket has a structurally stable and aerodynamic configuration which is reusable and results in a stable and true flight.

21 Claims, 8 Drawing Sheets

Fig. 4.
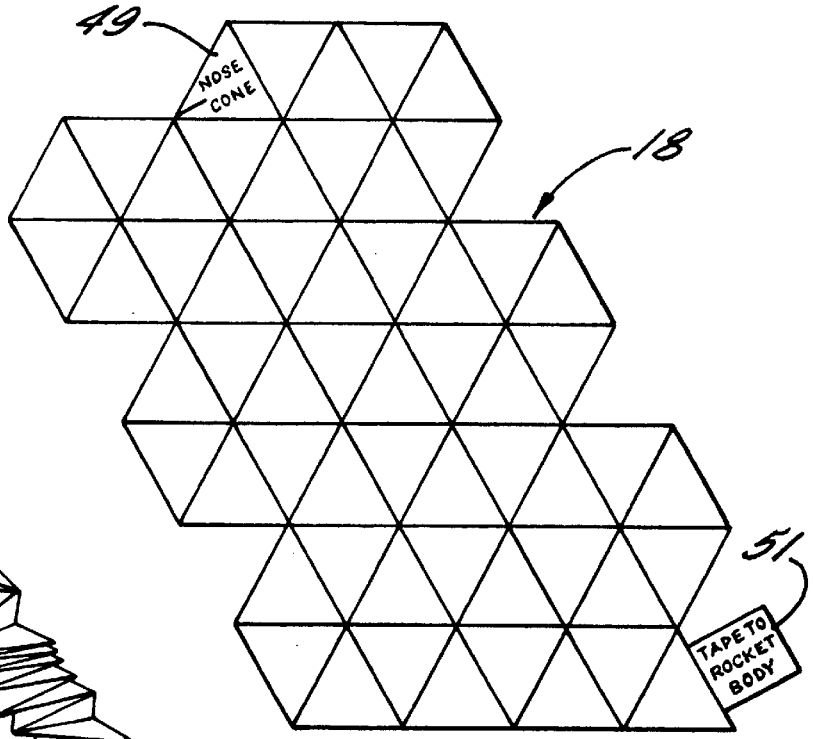
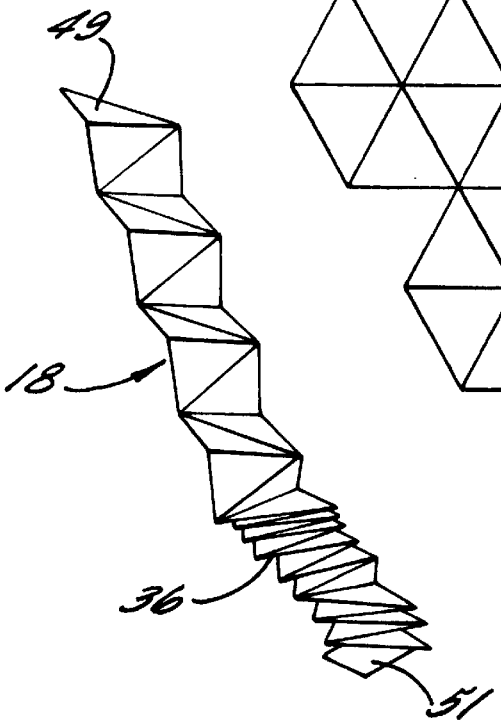
Fig. 5.

KIT FOR CONSTRUCTING A MODEL ROCKET

FIELD OF THE INVENTION

This invention generally relates to model rocketry and, more particularly, to a relatively inexpensive kit for constructing a model rocket.

BACKGROUND OF THE INVENTION

Numerous kits are commercially available for building model rockets. These kits typically include various parts constructed of molded plastic or rigid cardboard which must be assembled in order to form the rocket. The major components of a model rocket generally include the frame of the rocket itself, the fins and the parachute deployment device. In addition, a solid fuel engine or the like must be installed at the base of the rocket in order provide the power for launching the rocket.

Model rockets have essentially three stages of flight which are controlled at least to some extent by the operation of the solid fuel engine. The first stage is the powered ascent where the ignition of the engine launches the rocket into the air. A guide rod which engages complementary lugs on the rocket frame is typically used for the launch of the rocket in order to assist in aiming the rocket and to provide guidance during the critical first few moments of the flight. The second flight stage is the unpowered ascent which begins once the propellant in the engine has been expended. During this stage, the rocket continues to rise based upon the initial power expended during the powered ascent but the engine no longer provides any lift, however, it does continue to burn to provide a time delay. After the engine has burned through the time delay, the rocket it at or near the apogee of its flight and the ejection portion of the engine ignites deploying a parachute which enables the rocket to begin a slow descent back to the ground.

Constructing and launching model rockets is a hobby which has widespread appeal. Most commercially available model rocket kits, however, are prohibitively expensive for many people interested in model rocketry as a hobby. This is particularly true in the case of many kids. Much of the cost associated with these model rocket kits is attributable to the material and manufacturing cost of the large number of molded plastic or rigid cardboard parts which are included in the kit. In addition, other costs may also be involved as the assembly of the rocket generally also requires the use of tools such as, for example a knife, and an adhesive such as glue or cement.

Many commercially available model rockets are also quite complicated and time consuming to assemble making them inappropriate for many kids. In particular, many model rocket kits include a relatively large number of parts some which are very small. Assembly of the rocket often requires careful and precise placement and alignment of these parts. Accordingly, these kits are often unsuitable for kids, and for that matter for many adults, who may not have the inclination or the patience for delicate and time-consuming assembly operations.

Thus, a need exists for a relatively inexpensive and easy to construct model rocket kit. At the same time, however, structural rigidity and aerodynamics should not be sacrificed for the sake of cost or simplicity of construction. Instead, in order to maximize the enjoyment associated with launching a model rocket, such an easy to assemble low cost model rocket kit should provide a rocket which is capable, even after repeated use, of a straight and true flight which is comparable to much more expensive and complicated kits.

OBJECTS AND SUMMARY OF THE INVENTION

Accordingly, in view of the foregoing, it is a general object of the present invention to provide a model rocket kit which is relatively inexpensive.

A related object of the present invention is to provide a method by which a model rocket can be constructed from a die cut sheet of paper or cardboard or the like without the need for any glue.

A further object of the present invention is to provide a model rocket kit which can be assembled quickly and easily.

Another object of the present invention is to provide a relatively inexpensive model rocket which while lightweight is structurally rigid and thus reliable and reusable.

An additional object of the present invention is to provide a relatively inexpensive model rocket which is aerodynamic and stable during flight.

These and other features and advantages of the invention will be more readily apparent upon reading the following description of a preferred exemplary embodiment of the invention and upon reference to the accompanying drawings wherein:

BRIEF DESCRIPTION OF THE DRAWINGS

FIG. 4 is a plan view showing the first step in the assembly of the recovery device of the illustrative model rocket in accordance with the present invention.

FIG. 5 is a plan view showing the folding of the recovery device of the illustrative model rocket in accordance with the present invention.

While the invention will be described and disclosed in connection with certain preferred embodiments and procedures, it is not intended to limit the invention to those specific embodiments. Rather it is intended to cover all such alternative embodiments and modifications as fall within the spirit and scope of the invention.

DETAILED DESCRIPTION OF THE PREFERRED EMBODIMENT

Generally, the present invention relates to a model rocket kit which, while it has a substantially lower cost than conventional model rocket kits, nevertheless produces a structurally rigid and aerodynamic reusable model rocket. As will be described in detail below, unlike conventional model rocket kits which typically include a large number of molded plastic or rigid cardboard parts some of which are quite small, the model rocket kit of the present invention includes a relatively small number of parts all of which can be constructed from a single die cut sheet of cardboard or the like. This substantially reduces the material and manufacturing costs associated with producing the model rocket kit of the present invention. Moreover, the various parts of the present invention can be assembled within minutes into a model rocket simply by detaching the parts from the cardboard sheet, folding the parts into the appropriate form and securing them using conventional adhesive tape. Accordingly, the model rocket kit of the present invention eliminates the sometimes careful and delicate placement of parts which is needed with most conventional model rocket kits and the need to use glue or cement adhesives which make many commercially available model rocket kits unsuitable for many kids.

While the present invention is described in connection with a particular unique and novel model rocket configuration, it will be readily appreciated that the teachings of the model rocket kit of the present invention can also be applied to construct model rockets having other configurations. Similarly, it will also be appreciated that the unique model rocket configuration of the present invention could be assembled using some other method than the novel model rocket kit described herein.

Figure 1:
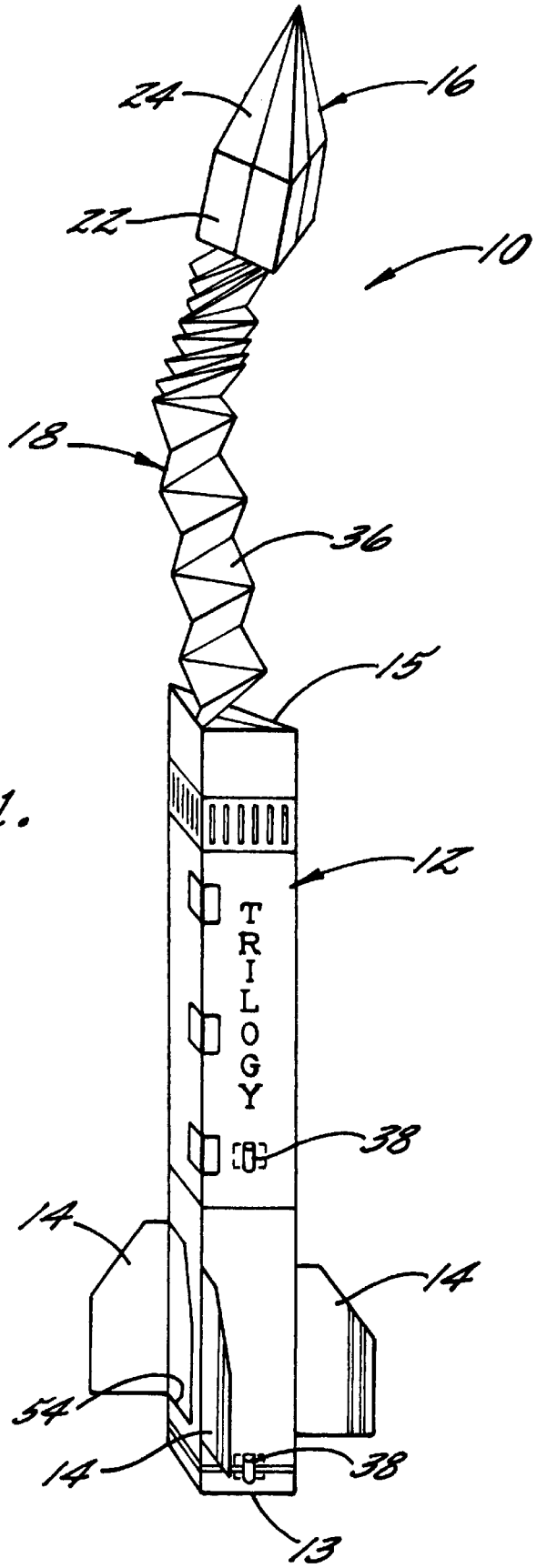
FIG. 1 is a side perspective view of an illustrative model rocket constructed in accordance with the teachings of the present invention with the recovery device deployed.
Figure 3:
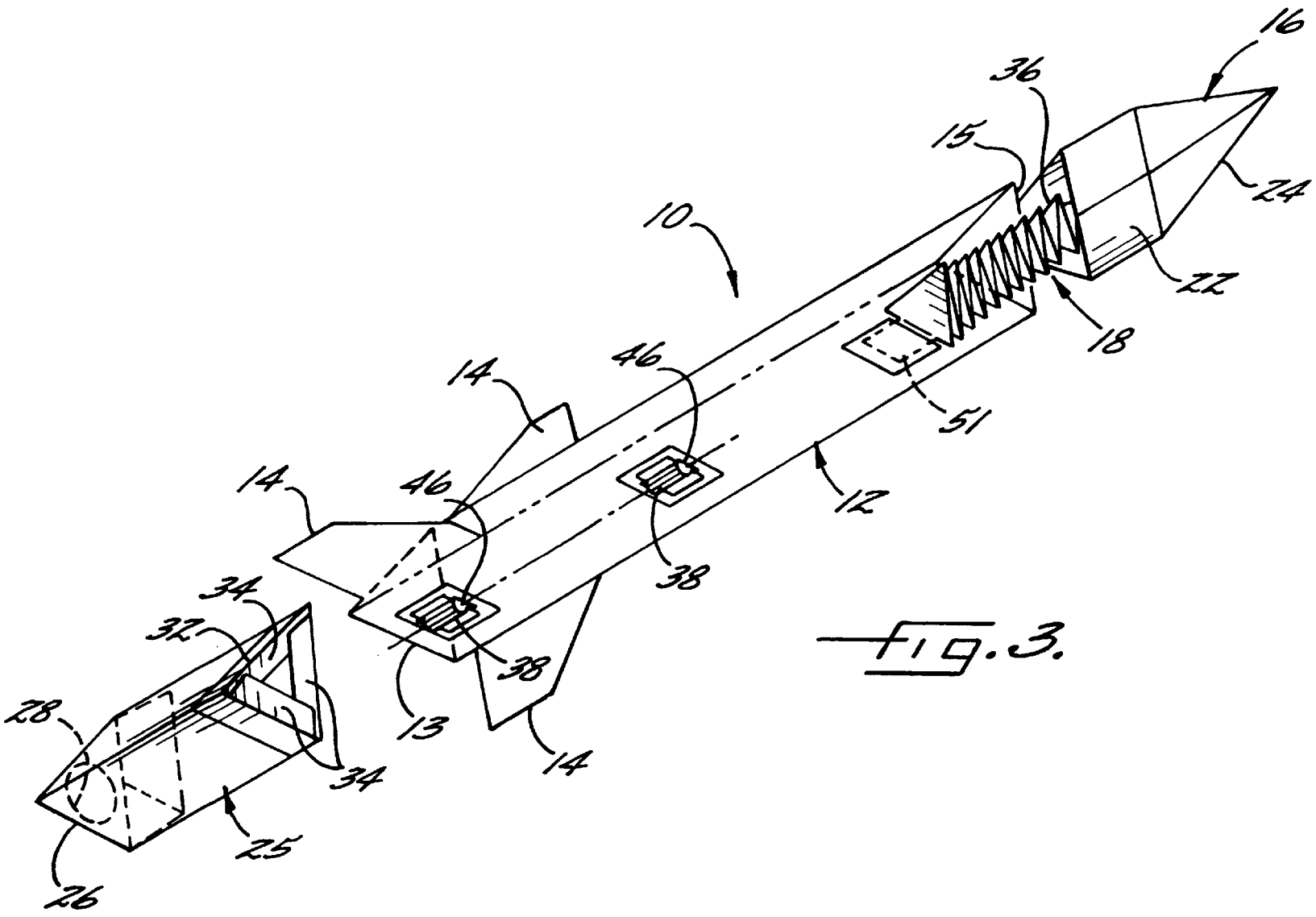
FIG. 3 is a partially cut away and exploded side perspective view of the illustrative model rocket.

Referring now more particularly to FIGS. 1 and 3, there is shown an illustrative model rocket 10 which has been constructed from a model rocket kit in accordance with the present invention. The model rocket 10 generally comprises an elongated rocket frame 12, a plurality of fins 14, a nose cone 16, and a recovery device 18 which enables the rocket to fall safely to the ground after it has been launched. The model rocket 10 is powered by a solid fuel engine 20 or the like which is installed in the base 13 of the rocket frame 12 and may be of conventional design. In one presently preferred embodiment, B6-4, C6-5 and C6-7 motors are recommended.

Figure 14:
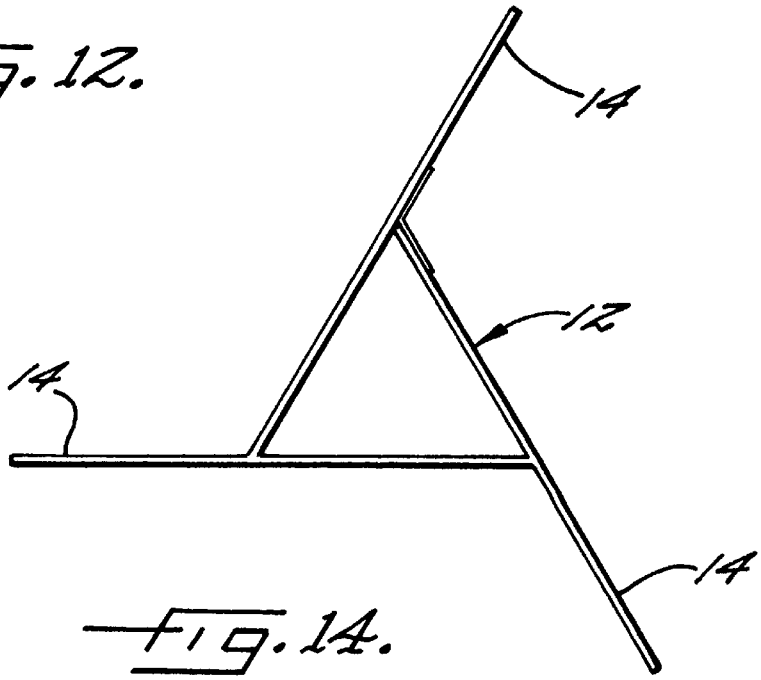
FIG. 14 is a cross-sectional view of the base of the illustrative model rocket.

In accordance with one important aspect of the present invention, the substantially hollow frame 12 is configured with three sides such that the frame 12 has a triangular cross section. In one presently preferred embodiment, the cross section of the frame 12 is an equilateral triangle as shown in FIG. 14. This configuration provides the frame 12, and in turn the entire model rocket 10, with substantial strength and structural stability enabling the frame 12 and the rest of the rocket 10 to be constructed from a relatively lightweight cardboard material as described below. The strength and structural stability provided by the three-sided configuration also enables the model rocket 10 to withstand repeated launchings despite its lightweight cardboard construction. In addition, the triangular configuration is also aerodynamic which in conjunction with the structural stability helps to ensure a stable, true and quite high flight path when the rocket is launched. It will be appreciated, however, that the frame could also have other polygonal configurations which include planar side walls such as for example rectangular. The planar side walls of these other configurations would also offer substantial structural stability.

The upper end 15 of the rocket frame 12 is capped by a nose cone 16. The nose cone 16 has a three-sided base portion 22 which is adapted to fit over the upper end of the rocket frame 12 and a tapered portion 24 wherein the three sides of the nose cone 16 taper to a single point forming a tetrahedron.

For guiding the model rocket during flight, a plurality of fins 14 are provided. As shown in FIGS. 1, 3 and 14, the illustrative model rocket 10 includes three fins 14 which are disposed adjacent the base 13 of the frame 12. As best shown in FIG. 14, each of the fins 14 is essentially coplanar with and extends from a respective one of the side walls of the rocket frame 12. Moreover, in the illustrated embodiment, each fin 14 is integral with a respective one of the side walls of the rocket frame 12. This integral construction ensures that the fins 14 will not be broken off during flight and, as will be described below, ensures that the fins 14 are accurately positioned without any need for painstaking and delicate assembly procedures. Additionally, configuring the fins in this manner has been found to provide a very stable and true flight.

Figure 9:
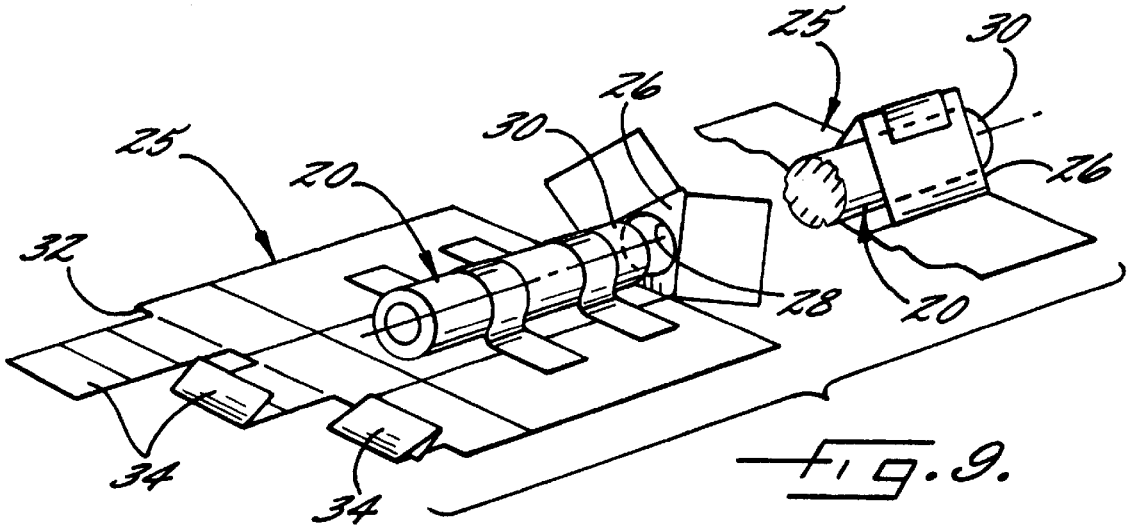
FIG. 9 is a perspective view showing the assembly of the engine mounting sleeve of the illustrative model rocket.
Figure 10:
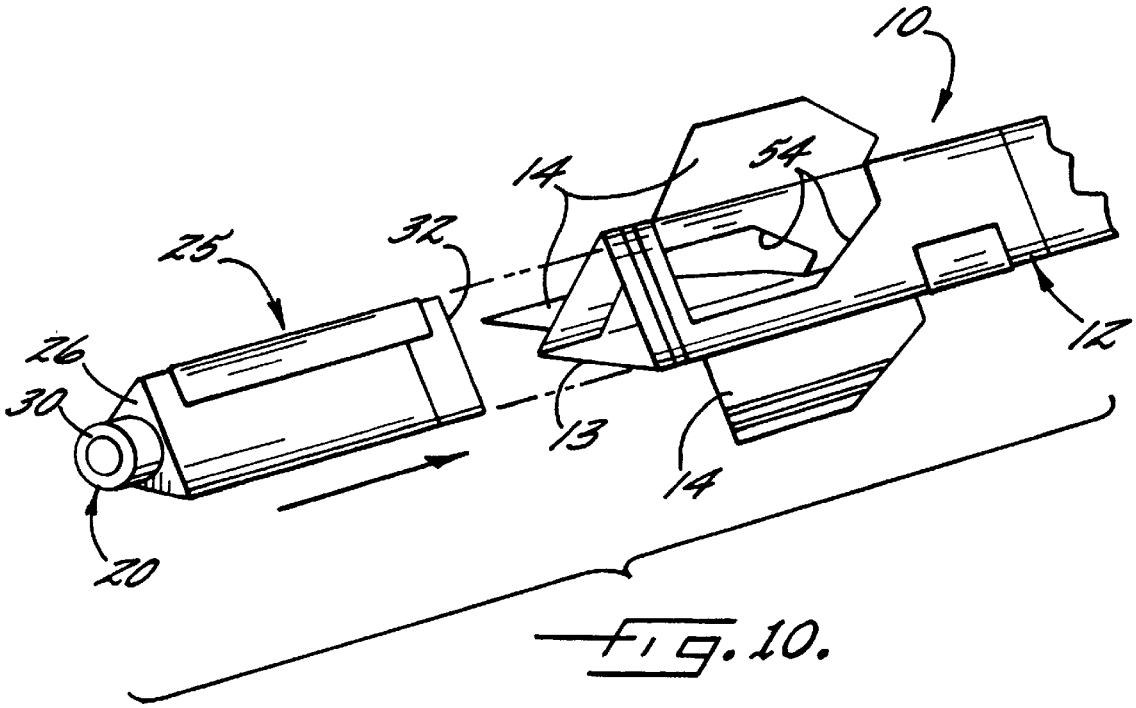
FIG. 10 is a perspective view showing the insertion of the engine and mounting sleeve in the frame of the illustrative model rocket.

For ensuring that the engine 20 is mounted in a centered position in the base of the rocket frame 12, the model rocket 10 includes an engine mounting sleeve 25. As best shown in FIGS. 9 and 10, the mounting sleeve 25 has three sides which define a hollow triangular body within which the cylindrical engine 20 is received. Once the engine 10 has been mounted within the sleeve 25, as described in greater detail below, the sleeve is adapted such that it can slide into the base 13 of the rocket frame 12 as shown in FIG. 9 in order to place the engine 20 in position for launch. As shown in FIGS. 9 and 10, the lower end 26 of the mounting sleeve includes a hole 28 through which the nozzle end 30 of the engine 20 projects. The upper end of the mounting sleeve 25 is open to enable the engine 20 to deploy the recovery device 18. As shown in FIG. 9, tabs 34 are provided on the adjacent the upper end of the inside of the side walls of the mounting sleeve 25 in order to help prevent upward movement of the engine 20 relative to the mounting sleeve.

In order to allow the model rocket 10 to return to the ground in a safe manner and in an undamaged and reusable condition, the model rocket 10 includes a recovery device 18. As best shown in FIGS. 1 and 3, in the illustrated embodiment the recovery device 18 comprises a baffle 36 which is connected at one end to the upper end of the rocket frame 12 and at the opposite end to the nose cone 16. The baffle 36 has a plurality of accordion-like folds which enable the baffle 36 to be resiliently compressed like a spring. In particular, the folds enable the baffle 36 to be resiliently compressed in a spring-like manner into a launch position wherein the baffle 36 is contained within the hollow interior of the rocket frame 12 and the nose cone 16 is arranged on the upper end 15 of the rocket frame.

Figures 13A, 13B, 13C:
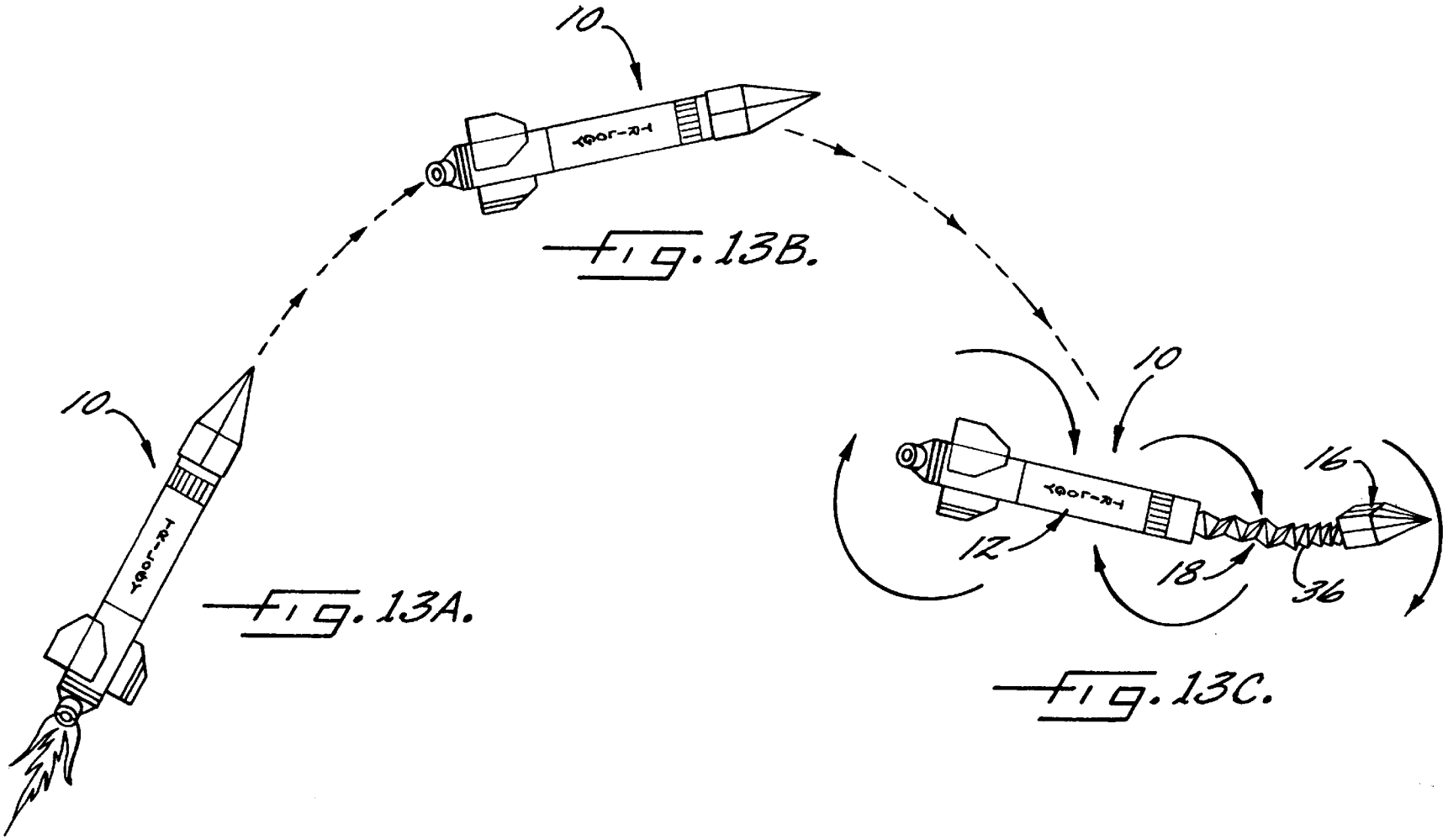
FIGS. 13A–C are diagrammatic views showing the three stages of flight of the illustrative model rocket.

As will be appreciated by those skilled in the art, the deployment of the recovery device 18 is controlled by the engine 20. In particular, as is known in the art, the burning of the propellant in the engine 20 powers the model rocket 10 during the initial powered ascent phase of a flight as is depicted in FIG. 13A. Once the propellant in the engine 20 has been expended, the model rocket 10 will continue to rise through an unpowered ascent stage of flight, depicted in FIG. 13B, based upon the momentum provided by the now burnt propellant. During the unpowered ascent stage, the engine 20 continues to burn, but only in a time delay mode. Once the engine 20 has burned through the time delay, the model rocket 10 is at or near the apogee of its flight and the ejection portion of the engine 20 ignites deploying the recovery device 18 to begin the slow descent stage of the flight. Specifically, as shown in FIG. 13C, the ignition of the ejection portion of the engine 20 blows off the nose cone 16 of the model rocket 10. The nose cone 16 however remains connected to the rocket frame 12 by the baffle 26 which unfolds as the nose cone separates from the rocket frame. The separation of the nose cone 16 and the resulting deployment of the baffle 26 increases the aerodynamic drag sufficiently to enable the model rocket 10 to tumble laterally (as opposed to end-over-end) gently back to the ground. In addition, the deployment of the baffle 26 provides the largest possible visual profile further aiding in the recovery of the model rocket. It has been found that the baffle recovery system can be eliminated on larger model rockets. In particular, the unique three-sided configuration of the frame and the coplanar positioning of the fins along with the larger surface area of the rocket is sufficient to put the rocket into a horizontal spin during the recovery phase.

In order to guide the model rocket during takeoff, the rocket 10 includes launch lugs 38. As shown in FIGS. 1 and 3, the illustrative model rocket includes a pair of launch lugs 38 which are provided on one of the side walls of the frame 12. The launch lugs 38 are adapted to operatively engage a conventional guide rod (not shown) such that the rocket can slide easily up and down on the guide rod. The guide rod directs the rocket during takeoff and thereby enables the model rocket to be aimed more accurately.

Figure 2:
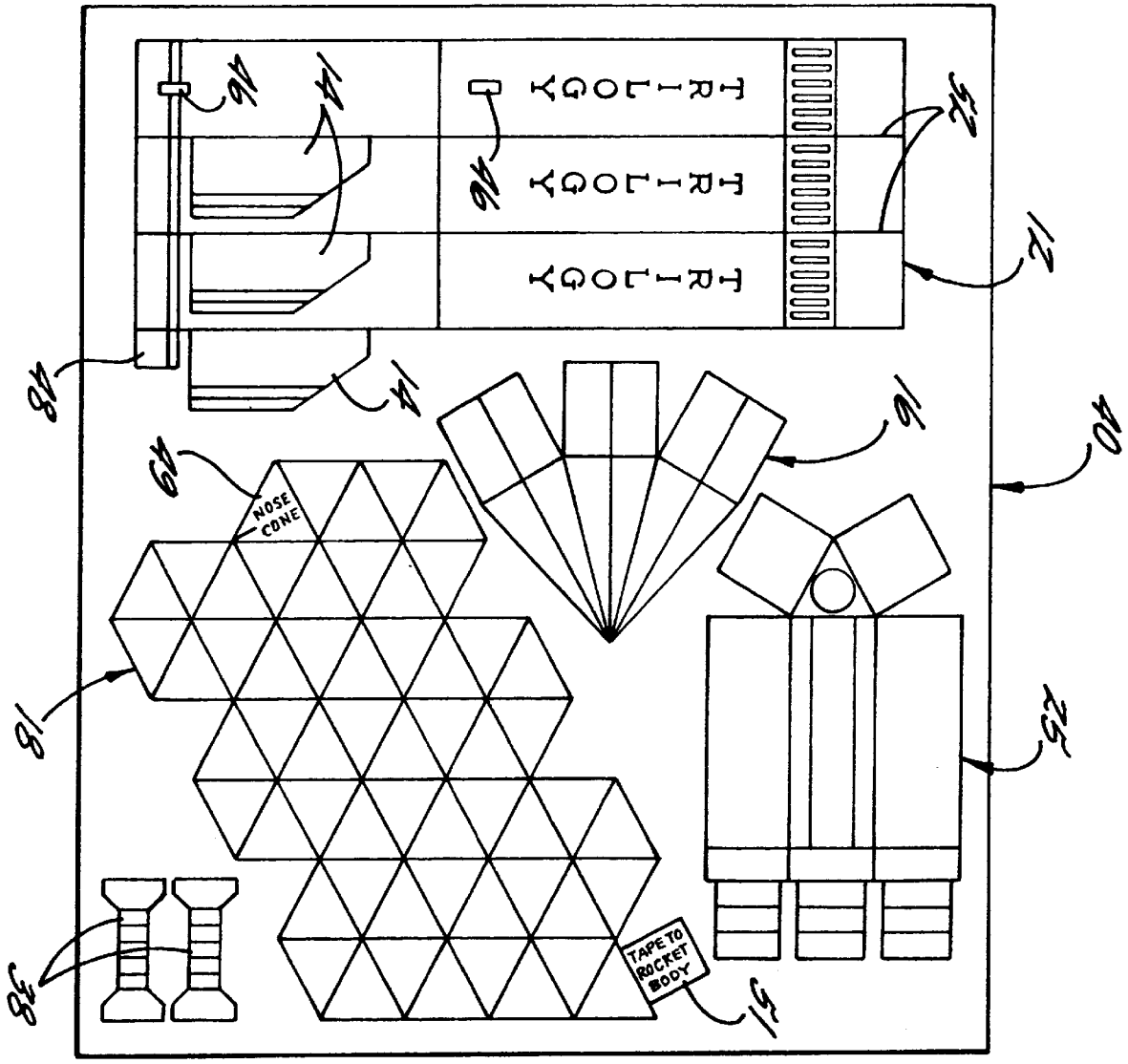
FIG. 2 is a plan view of the die cut sheet which in accordance with the present invention is used to construct the various components of the model rocket of FIG. 1.

In accordance with another important aspect of the present invention, the model rocket 10 is adapted such that it can be constructed simply by detaching the various component parts from a single die cut sheet of cardboard or the like, folding the parts into the appropriate form and securing them with conventional adhesive tape. In particular, FIG. 2 shows an illustrative embodiment of a cardboard assembly sheet 40 which has been printed and die cut such that it includes the various component parts of the model rocket 10 in unassembled form, i.e. the frame 12 and fins 14, nose cone 16, recovery device 18, engine mounting sleeve 25 and launch lugs 38. It is preferred the assembly sheet 40 be constructed of relatively lightweight cardboard, paperboard or the like such as for example 14 point cardboard. However, corrugated cardboard may be used for larger model rockets such as those over two feet tall. This ensures that the various component parts can be easily folded while offering sufficient structural stability to enable the rocket to achieve a stable flight. While the illustrated embodiment of the invention only includes a single sheet of cardboard or paperboard it will be appreciated that the various components parts could be provided on several sheets. As is known in the die cutting art, each of the components of the model rocket 10 are die cut in the assembly sheet 40 such that they remain connected to the assembly sheet by weakened web portions. In order to begin the assembly operation, the various components parts are removed from the assembly sheet 40 by bursting the weakened web portions. Since the parts are held on the sheet 40 only via the weakened web portions, there is no need to use a cutting implement such as scissors. This can be a significant advantage particularly with younger children. It will be appreciated, however, that the assembly sheet 40 could simply be printed with the outline of the various parts of the model rocket. The individual assembling the model rocket would then have to cut out the various pieces from the assembly sheet 40 using scissors or the like.

Figure 6:
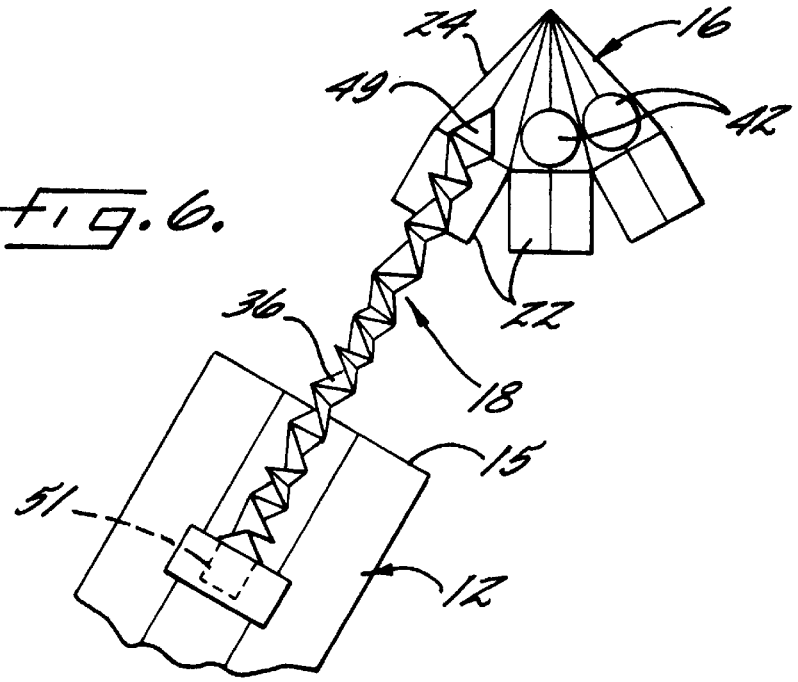
FIG. 6 is a plan view showing the attachment of the recovery device to the nose cone and the frame of the illustrative model rocket.

Once the various parts have been removed from the assembly sheet 40, the model rocket 10 may be assembled simply by folding the components along preprinted fold lines and then taping the various components together. One presently preferred method for assembling the illustrative model rocket 10 is as follows. First, a pair of pennies 42, or some other object of similar weight, should be taped to the inside of the walls of the nose cone 16 as shown in FIG. 6. The pennies 40 provide the nose cone 16 with additional weight which ensures the stability of the flight of the model rocket.

Next, the baffle 36 can be assembled by simply by folding it in an accordion-like manner. In particular, when it is removed from the assembly sheet 40, the baffle 36 is in the form of a serpentine strip of cardboard which has a plurality of triangles printed thereon as shown in FIG. 4. To form the baffle 36, the strip is folded one triangle at a time beginning at one end such that when the folding is completed the baffle 36 squeezes together like a spring (see FIG. 5). The end 49 of the baffle 36 which has a triangular configuration is then taped to the inside of one of the side walls of the nose cone 16 as shown in FIG. 6. Preferably, the baffle 36 is taped to one of the side walls to which a penny 40 or other weight is not attached. The opposite end 51 of the baffle, which is configured as a rectangular tab, is attached to the inside of the center side wall of the unassembled rocket frame 12 a short distance below the upper end 15 of the frame 12. In one presently preferred embodiment, the baffle 36 is connected approximately 2½ inches below the upper end 15 of the frame 12.

Figure 7:
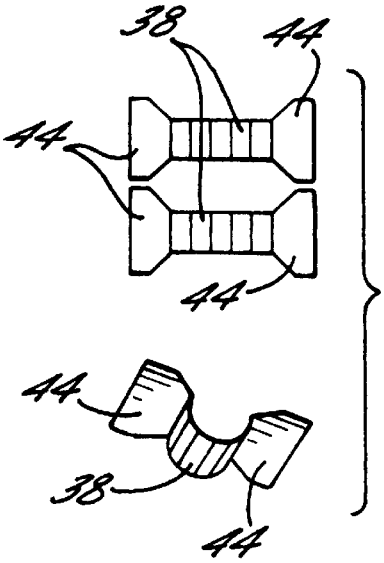
FIG. 7 shows the assembly of the launch lugs of the illustrative model rocket.

As shown in FIG. 7, the launch lugs 38 are assembled by wrapping them around a cylindrical object such as a pencil and then bending the tabs 44. Once the launch lugs 38 are formed they can be inserted into corresponding holes 46 provided in one side walls of the frame 12 such that the lugs 38 extend outwardly from the outside surface of the rocket frame as shown in FIG. 3. The launch lugs 38 are then secured in position by adhesive tape.

Figure 8:
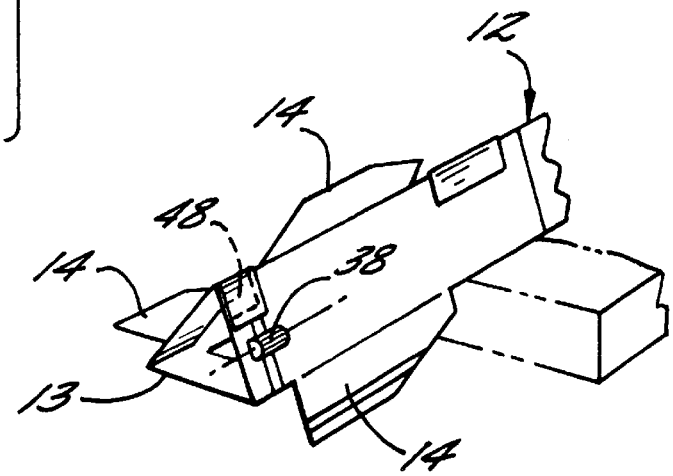
FIG. 8 is a perspective view of the base of the frame of the illustrative model rocket showing how the frame is taped together.
Figure 11:
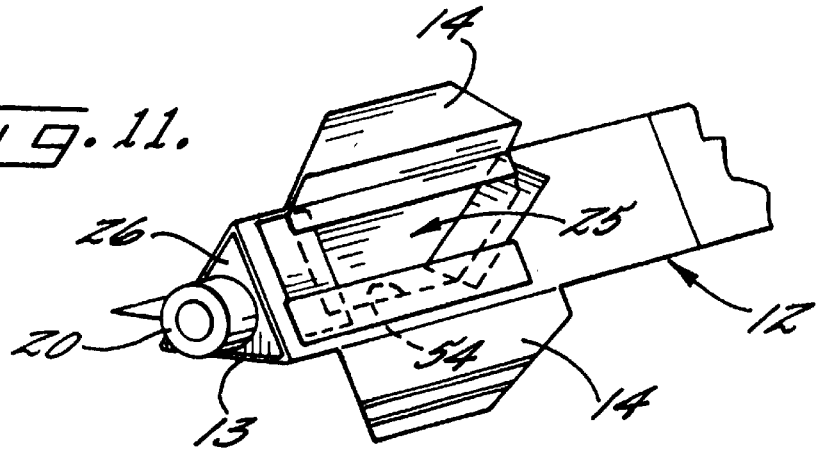
FIG. 11 is a perspective view of the base of the illustrative model rocket showing how the mounting sleeve is secured to the frame.

Once the baffle and the launch lugs have been attached, the frame 12 can be assembled. This is accomplished by folding the frame 12 along the two fold lines 52 (FIG. 2) which separate the three sides of the frame 12. Since in the illustrated embodiment each fin 14 is integral with one of the sides of the frame 12, the fins associated with two of the side walls must be die cut out of the adjacent side walls of the frame. Thus, when the frame 12 is folded, these two fins should pop out of the respective side walls from which they are cut, leaving a pocket or window 54 in the side wall, one of which is shown in FIGS. 1, 10 and 11. Accordingly, the fins 14 automatically move into the proper position when the frame 12 is folded. Thus, unlike most conventional model rocket kits, there is no need for painstaking and delicate placement of the fins. Since the fins 14 should be coplanar with their corresponding side wall, care should be taken during folding of the frame 12 to ensure that the fins 14 are not folded where they are connected to their corresponding side wall. In this regard, it may be helpful to fold the frame 12 using the edge of a flat surface such as a table. In order to help secure the frame 12, a tab 48 (shown unassembled in FIG. 2) is provided along the base 13 of the frame. Once the frame 12 is folded and taped together, the tab 48 is folded over and taped (see, e.g. FIG. 12). Preferably, this is done with the base 13 of the frame hanging over the edge of a table or the like, in order to prevent damage to the fins 14 as shown in FIG. 8.

Next, the nose cone 16 is folded into the shape of a tetrahedron and secured via tape applied along the seam of the tapered portion 24 of the nose cone. When the nose cone 16 is assembled, the tape should be tightly wrapped around the tip of the nose cone 16. The tabs which form the base 22 of the nose cone 16 may then be taped together along the seams. When the nose cone 16 is placed on the upper end 15 of the rocket frame it should have a snug but not tight fit. As will be appreciated, if the nose cone 16 fits too tightly on the frame 12, the recovery device 18 will not deploy properly. Similarly, if the nose cone 16 is too loose it may inadvertently become dislodged during flight.

In order to assemble the engine mounting sleeve 25, it is first laid face down and the three tabs 34 which are positioned at the upper end of the inside of the side walls are folded. Next, the triangle shaped piece which forms the lower end 26 of the mounting sleeve 25 is folded up and the nozzle end 30 of the engine is inserted through the hole 28 in the lower end of the sleeve until the top of the engine 20 rests against the folded tabs as shown in FIG. 9. The engine 20 should then be centered in the sleeve 25 and secured in position via tape. The two tabs on the lower end 26 of the mounting sleeve are then folded in, aligned and taped. Finally, the sides of the mounting sleeve 25 can be folded up and then taped together along the seam.

Figure 12:
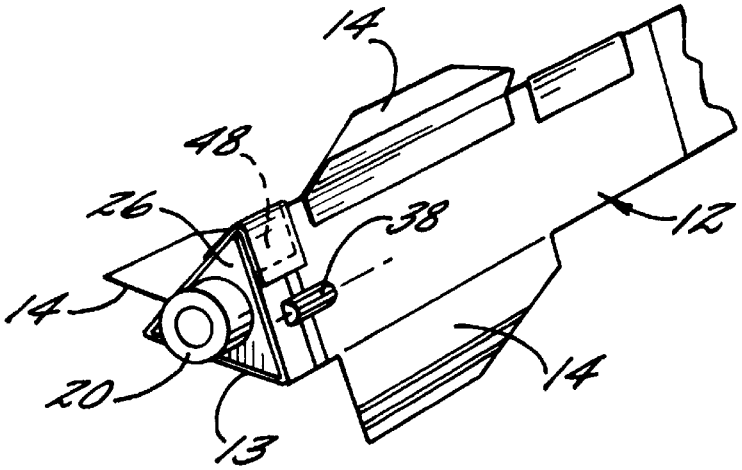
FIG. 12 is a perspective view of the base of the illustrative model rocket showing how the third fin is secured to the frame.

Once the assembly of the engine mounting sleeve 25 is completed, the sleeve can be slid (FIG. 10) into the base 13 of the frame to the point where the lower end of the mounting sleeve 25 is flush with the lower edge of the base of the frame. The engine mounting sleeve 25 can then be secured in place by taping the frame 12 along the pockets 54 where the frame 12 and the sleeve 25 meet as shown in FIG. 12. Lastly, the only fin which is not cut from one of the side walls of the frame should be taped to the side of the frame 12 which does not have a pocket as shown in FIG. 12. This ensures that the base 13 of the frame remains tightly assembled.

From the foregoing it can be seen that the model rocket construction of the present invention offers several significant advantages over conventional model rockets. These include a frame with a three-sided configuration which offers superior structural stability and aerodynamics, thus enabling the rocket to be constructed from a relatively lightweight cardboard material. In addition, the model rocket has fins which are integral and coplanar with a respective one of the side walls of the frame. These fins eliminate the need for delicate and painstaking assembly operations and also provide a very stable and true flight. The kit and assembly method of the present invention also offer significant advantages over conventional model rocket kits. For example, all of the parts of the model rocket may be formed from a single flat sheet of die-cut cardboard, thereby substantially reducing the material and manufacturing costs of the kit. Moreover, the kit of the present invention can be assembled simply with conventional adhesive tape and without the need for any scissors. Thus, the kit is much more suitable for use by younger kids than conventional model rockets.

While this invention has been described with an emphasis upon preferred embodiments, it will be obvious to those of ordinary skill in the art that variations of the preferred embodiments may be used and that it is intended that the invention may be practiced otherwise than as specifically described herein. Accordingly, this invention includes all modifications encompassed within the spirit and the scope of the invention as defined by the following claims.

What is claimed is:

1. A model rocket which can be launched using an engine, the model rocket comprising:

a frame having a base end, an opposing upper end, and a plurality of interconnected planar side walls defining a perimeter of the frame, a fin extending from and integral and coplanar with each of the side walls of the frame adjacent the base end of the frame such that the fins are symmetrically arranged about the perimeter of the frame, a nose cone removably attached to the upper end of the frame, and a recovery system connected to the frame and disposed in a launch position in the interior of the frame, the recovery system being adapted to deploy upon actuation by the engine to control the descent of the rocket.

2. The invention according to claim 1 further including a sleeve for mounting the engine, the sleeve having open upper and lower ends and three sides which define a hollow interior for receiving the engine, the sleeve being adapted to be telescopingly received in the base of the frame.

3. The invention according to claim 2 wherein the sleeve includes tabs arranged on the inside of the side walls of the sleeve for engaging the engine, the tabs being adapted to prevent the engine from moving upwards relative to the sleeve when the rocket is launched.

4. The invention according to claim 1 wherein the recovery device comprises a baffle having a first end connected to the frame and a second end connected to the nose cone, the baffle including a plurality of accordion folds which permit the baffle to be resiliently compressed into the interior of the frame and unfold as the nose cone separates from the frame upon deployment of the recovery device.

5. The invention according to claim 1 wherein the nose cone has three sides and is configured as a tetrahedron, the nose cone further being adapted to slide over the upper end of the frame.

6. The invention according to claim 1 further including at least one launch lug arranged on one of the side walls of the frame.

7. The invention according to claim 1 wherein the frame is constructed from cardboard or paperboard.

8. The invention according to claim 7 wherein the fins, nose cone and recovery device are constructed from cardboard or paperboard.

9. A model rocket which can be launched using an engine, the model rocket comprising:

a frame having a base end, an opposing upper end, and side walls which define a perimeter of the frame, each of the side walls being integral with at least one adjoining side wall, a plurality of fins arranged adjacent the base of the frame, each of the fins extending from and being coplanar with a respective one of the side walls of the frame such that the fins are symmetrically arranged about the perimeter of the frame, and a nose cone arranged on the upper end of the frame.

10. The invention according to claim 9 further including a recovery system connected to the frame and disposed in a launch position in the interior of the frame, the recovery system being adapted to deploy upon actuation by the engine to control the descent of the rocket.

11. The invention according to claim 10 wherein the nose cone is removably attached to the upper end of the frame and the recovery device comprises a baffle having a first end connected to the frame and a second end connected to the nose cone, the baffle including a plurality of accordion folds which permit the baffle to be resiliently compressed into the interior of the frame and unfold as the nose cone separates from the frame upon deployment of the recovery device.

12. The invention according to claim 9 further including a sleeve for mounting the engine, the sleeve having open upper and lower ends and three sides which define a hollow interior for receiving the engine, the sleeve being adapted to be telescopingly received in the base of the frame.

13. The invention according to claim 9 wherein the frame is constructed from cardboard or paperboard.

14. The invention according to claim 10 wherein the fins, nose cone and recovery device are constructed from cardboard or paperboard.

15. A kit for constructing a model rocket comprising one or more planar sheets of cardboard or paperboard adapted such that a plurality of pieces representing the outline of a frame, a nose cone, a recovery device and an engine mounting sleeve in unassembled form can be removed therefrom, each of the pieces including fold indicators along which the respective pieces can be folded to form a respective one of the frame, nose cone, recovery device and engine mounting sleeve of the model rocket with the frame being formed by folding a single piece.

16. The invention according to claim 15 wherein the plurality of pieces representing the outline of the frame, the nose cone, the recovery device and the mounting sleeve are adapted to be held in their folded form by adhesive tape.

17. The invention according to claim 15 wherein the plurality of pieces are pre-cut in the one or more planar sheets of cardboard or paperboard so as to be held to the sheets by weakened web portions.

18. A kit for constructing a model rocket comprising one or more planar sheets of cardboard or paperboard adapted to form a model rocket having a frame having a base end, an opposing upper end, and a plurality of side walls which define a perimeter of the frame, each of the side walls being integral with at least one adjoining side wall, a plurality of fins arranged adjacent the base of the frame, each of the fins extending from and being coplanar and integral with a respective one of the side walls of the frame such that the fins are symmetrically arranged about the perimeter of the frame, and a nose cone arranged on the upper end of the frame.

19. The invention according to claim 18 wherein the one or more planar sheets of cardboard or paperboard are further adapted to form a recovery device for the model rocket, the recovery device comprising a baffle having a first end connected to the frame and a second end connected to the nose cone, the baffle including a plurality of accordion folds which permit the baffle to be resiliently compressed into the interior of the frame and unfold as the nose cone separates from the frame upon deployment of the recovery device.

20. A model rocket which can be launched using an engine, the model rocket comprising:

a substantially hollow frame having a base end, an opposing upper end, and a plurality of interconnected planar side walls, a fin extending from and coplanar with each of the side walls of the frame adjacent the base end of the frame, a nose cone removably attached to the upper end of the frame, a recovery system connected to the frame and disposed in a launch position in the interior of the frame, the recovery system being adapted to deploy upon actuation by the engine to control the descent of the rocket, and a sleeve for mounting the engine, the sleeve having open upper and lower ends and three sides which define a hollow interior for receiving the engine, the sleeve being adapted to be telescopingly received in the base of the frame.

21. A model rocket which can be launched using an engine, the model rocket comprising:

a substantially hollow frame having a base end, an opposing upper end, and a plurality of interconnected planar side walls, a fin extending from and coplanar with each of the side walls of the frame adjacent the base end of the frame, a nose cone removably attached to the upper end of the frame, and a recovery system connected to the frame and disposed in a launch position in the interior of the frame, the recovery system being adapted to deploy upon actuation by the engine to control the descent of the rocket and wherein the recovery device comprises a baffle having a first end connected to the frame and a second end connected to the nose cone, the baffle including a plurality of accordion folds which permit the baffle to be resiliently compressed into the interior of the frame and unfold as the nose cone separates from the frame upon deployment of the recovery device.

* * * * *